US012781479B2

(12) United States Patent
Ruvang

(10) Patent No.: US 12,781,479 B2
(45) Date of Patent: Nov. 3, 2026

(54) WEAR COMPONENT SECUREMENT

(71) Applicant: BLACK CAT WEAR PARTS, LTD., Edmonton (CA)

(72) Inventor: John A. Ruvang, Bartonville, TX (US)

(73) Assignee: BLACK CAT WEAR PARTS, LTD., Edmonton (CA)

( * ) Notice: Subject to any disclaimer, the term of this patent is extended or adjusted under 35 U.S.C. 154(b) by 221 days.

(21) Appl. No.: 17/351,493

(22) Filed: Jun. 18, 2021

(65) Prior Publication Data

US 2022/0403629 A1 Dec. 22, 2022

(51) Int. Cl.
*E02F 9/28* (2006.01)

(52) U.S. Cl.
CPC ..... *E02F 9/2841* (2013.01); *E02F 9/2883* (2013.01)

(58) Field of Classification Search
CPC ..... E02F 9/2841; E02F 9/2816; E02F 9/2883; E02F 9/2825
See application file for complete search history.

(56) References Cited

U.S. PATENT DOCUMENTS

| | | | | |
|---|---|---|---|---|
| 5,718,070 A * | 2/1998 | Ruvang | E02F 9/2833 | 37/459 |
| 5,784,813 A * | 7/1998 | Balassa | E02F 9/2825 | 37/457 |
| 6,108,950 A | 8/2000 | Ruvang | | |
| 6,119,378 A * | 9/2000 | Pippins | E02F 9/2891 | 37/458 |
| 6,125,559 A | 10/2000 | Mullenhour | | |
| 6,439,796 B1 * | 8/2002 | Ruvang | E02F 9/2841 | 403/223 |
| 7,162,818 B2 | 1/2007 | Ruvang et al. | | |
| 7,178,274 B2 | 2/2007 | Emrich | | |
| 7,832,129 B2 * | 11/2010 | Briscoe | E02F 9/2883 | 37/456 |

(Continued)

FOREIGN PATENT DOCUMENTS

| | | | | |
|---|---|---|---|---|
| CA | 2233745 A1 * | 3/1999 | E02F 9/2825 | |
| CN | 108699818 A | 10/2018 | | |
| KR | 20210069418 A | 11/2021 | | |
| WO | WO-9721880 A1 * | 6/1997 | E02F 9/2825 | |
| WO | WO-2004007852 A1 * | 1/2004 | E02F 9/2841 | |
| WO | WO-2021072488 A1 * | 4/2021 | | |

OTHER PUBLICATIONS

International Search Report with Written Opinion issued Sep. 19, 2022 for PCT Patent Application No. PCT/IB2022/055547, 13 pages.

(Continued)

*Primary Examiner* — Christopher J Sebesta
*Assistant Examiner* — Blake E Scoville
(74) *Attorney, Agent, or Firm* — Smith IP Services, P. C.

(57) ABSTRACT

A wear component securement system can include a housing securable against rotation relative to a wear component, a pin rotatable in a passage of the housing about an axis of rotation, the pin being configured to displace along the axis of rotation in response to rotation of the pin in the passage, and a resilient member that resists rotation of the pin away from a locked position relative to the housing. A method can include installing a housing, a pin received in the housing, and a resilient member that resists rotation of the pin, the installing including preventing rotation of the housing relative to the wear component, and rotating the pin to a locked position, thereby aligning at least one bearing surface of the pin with at least one bearing surface of the wear component.

11 Claims, 16 Drawing Sheets

(56) References Cited

U.S. PATENT DOCUMENTS

| | | | | |
|---|---|---|---|---|
| 8,127,476 | B2 * | 3/2012 | Bierwith | E02F 9/2833 172/772 |
| 10,370,828 | B2 * | 8/2019 | Ruvang | E02F 9/2825 |
| 2003/0070330 | A1 * | 4/2003 | Olds | E02F 9/2825 37/456 |
| 2005/0028407 | A1 * | 2/2005 | Ruvang | E02F 9/2833 37/456 |
| 2006/0078373 | A1 * | 4/2006 | Dingwall | E02F 9/2841 411/351 |
| 2010/0236108 | A1 * | 9/2010 | Ruvang | E02F 9/2841 37/455 |
| 2011/0194912 | A1 | 8/2011 | Dingwall et al. | |
| 2012/0055052 | A1 * | 3/2012 | Campomanes | E02F 9/2833 37/456 |
| 2012/0304505 | A1 | 12/2012 | Ruvang | |
| 2013/0174453 | A1 * | 7/2013 | Cheyne | E02F 9/2825 37/456 |
| 2014/0013635 | A1 * | 1/2014 | Cui | E02F 9/2841 37/456 |
| 2014/0186105 | A1 * | 7/2014 | Martinelli | F16G 15/06 403/320 |
| 2015/0007464 | A1 * | 1/2015 | Simpson | E02F 9/2825 37/456 |
| 2016/0083935 | A1 * | 3/2016 | Edmonds | E02F 9/2833 37/456 |
| 2016/0222634 | A1 * | 8/2016 | Chiolerio | E02F 9/2825 |
| 2017/0167118 | A1 * | 6/2017 | Lombardo | F16B 15/00 |
| 2017/0314235 | A1 * | 11/2017 | Knight | E02F 9/2833 |

OTHER PUBLICATIONS

Argentina Office Action issued Feb. 25, 2025 for AR Patent Application No. 126175, 7 pages.
English Translation of Argentina Office Action issued Feb. 25, 2025 for AR Patent Application No. 126175, 4 pages.
Kazakhstan Examiner's Request issued Dec. 18, 2023 for KZ Patent Application No. 2023/0863.1, 3 pages.
English Translation of Kazakhstan Examiner's Request issued Dec. 18, 2023 for KZ Patent Application No. 2023/0863.1, 3 pages.
Chilean Examiner's Report issued Mar. 3, 2025 for CL Patent Application No. 202303303, 14 pages.
English Translation of Examiner's Report issued Mar. 3, 2025 for CL Patent Application No. 202303303, 13 pages.
Chilean Search Report issued Mar. 3, 2025 for CL Patent Application No. 202303303, 3 pages.
English Translation of Search Report issued Mar. 3, 2025 for CL Patent Application No. 202303303, 2 pages.
Google English Translation of KR20210069418 A (Son, Seong Goog) dated Nov. 6, 2021, 6 pages.
Office Action issued Dec. 18, 2025 for Chinese Patent Application No. 202280039705.7, 13 pages.
English Translation of Office Action issued Dec. 18, 2025 for Chinese Patent Application No. 202280039705.7, 16 pages.
Chilean Examiner's Response issued Sep. 10, 2025 for CL Patent Application No. 202303303, 20 pages.
English Translation for Chilean Examiner's Response issued Sep. 10, 2025 for CL Patent Application No. 202303303, 20 pages.

* cited by examiner

WEAR COMPONENT SECUREMENT

BACKGROUND

This disclosure relates generally to mining, excavation and material handling equipment and, in an example described below, more particularly provides for securement of a wear component to an implement.

The forward edge of material handling implements, such as buckets and shovels, etc., is subject to impacts, abrasion and other types of wear and damage. Expendable wear components, such as teeth, shrouds and adapters, can be used to protect a forward edge of a material handling implement. However, a fastening system used to releasably attach a wear component to an implement will also be subject to wear and damage in use, and so the fastening system should be robust, convenient and safe to use, reliable and economical.

It will, therefore, be appreciated that improvements are continually needed in the art of securing wear components to material handling implements. Such improvements are provided to the art by the present disclosure, and these improvements can be realized in a wide variety of different configurations.

DETAILED DESCRIPTION

Figure 1:
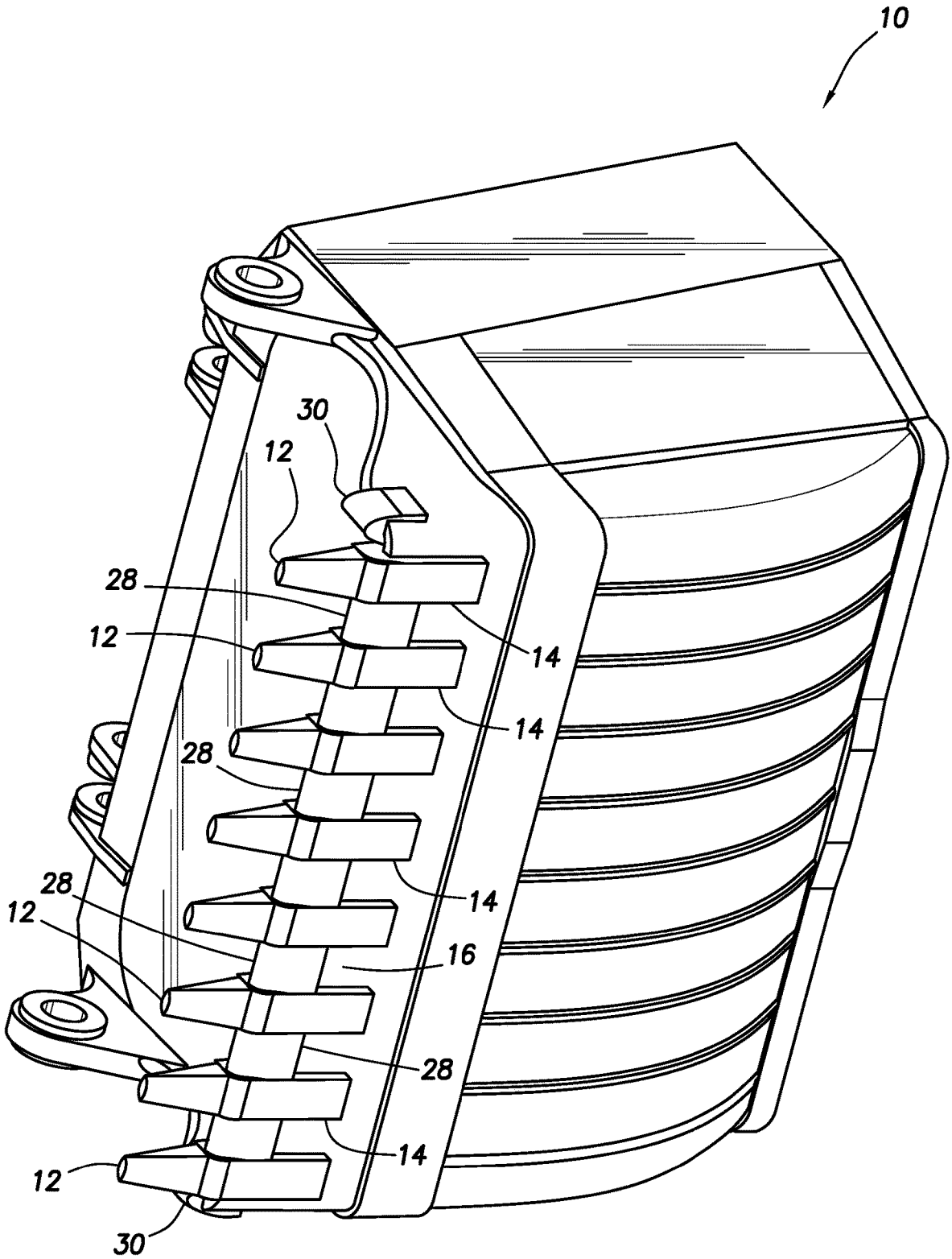
FIG. 1 is a representative partially cross-sectional view of an example of a material handling implement which can embody principles of this disclosure.

Representatively illustrated in FIG. 1 is an implement 10 for a material handling apparatus which can embody principles of this disclosure. However, it should be clearly understood that the implement 10 is merely one example of an application of the principles of this disclosure in practice, and a wide variety of other examples are possible. Therefore, the scope of this disclosure is not limited at all to the details of the implement 10 described herein and/or depicted in the drawings.

In the example of FIG. 1, the implement 10 is of the type known as a "dipper" or "bucket" of a cable shovel, but it should be clearly understood that the principles of this disclosure can be utilized with other types of excavation (or other material handling) implements. In the illustration of FIG. 1, the implement 10 is rotated so that a bottom material-engaging side of the implement is clearly visible. From this perspective, it may be seen that multiple teeth 12 are mounted on the implement 10 for piercing the earth or other material.

These teeth 12 are typically rapidly worn down or otherwise damaged during use of the implement 10, and so the teeth are replaced periodically or when excessive wear is evident. Specially configured adapters 14 releasably secure the teeth 12 to a forward edge of a lip 16 of the implement 10 in this example. In other examples, the teeth 12 may be secured directly to the lip 16.

The teeth 12 and adapter 14 are merely examples of wear components that can be securely and conveniently attached to a material handling implement using the principles of this disclosure. Other examples of wear components include shrouds 28, 30 which protect forward material-engaging edges of the lip 16 and sides of the implement 10. Thus, the scope of this disclosure is not limited to use of any particular types of wear components.

Figure 2:
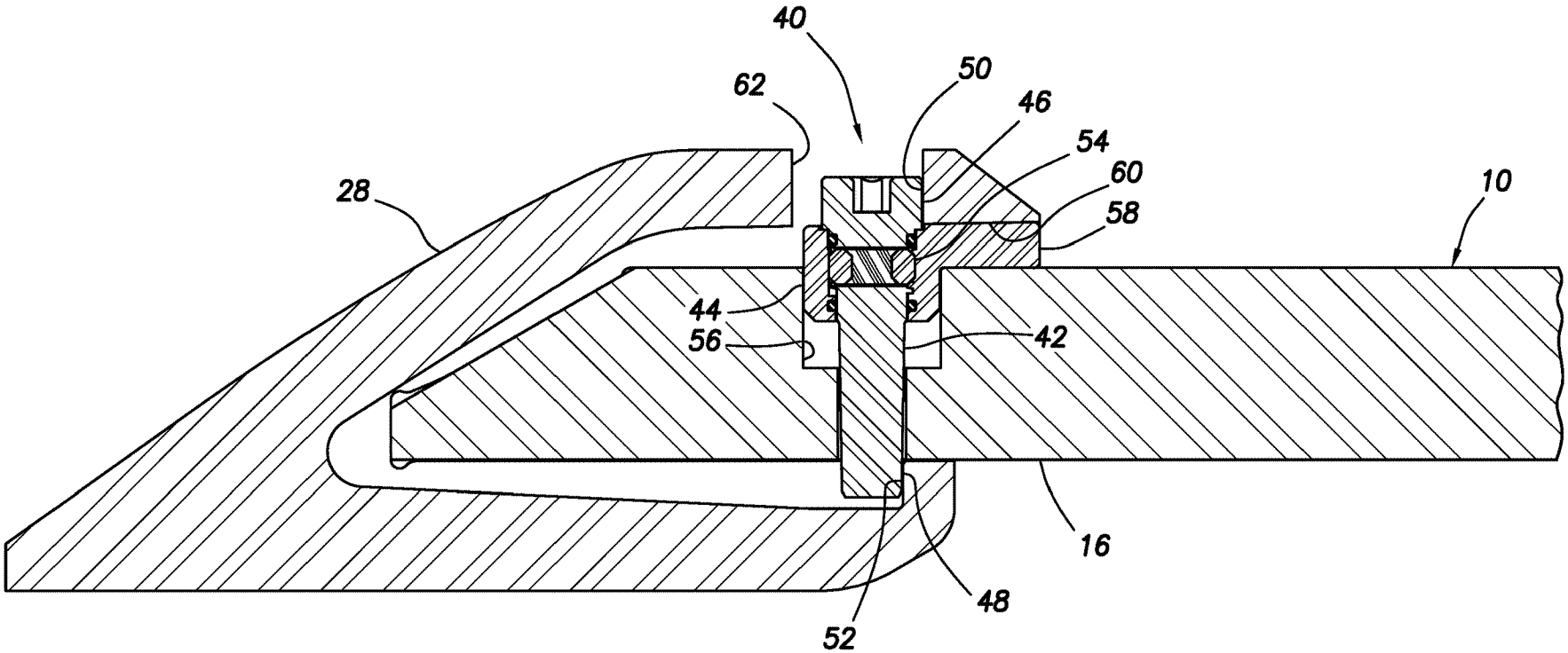
FIG. 2 is a representative cross-sectional view of an example of a wear component securement system that can be used to secure a wear component to a material handling implement.

Referring additionally now to FIG. 2, a cross-sectional view of an example of a wear component securement system 40 is representatively illustrated. The wear component securement system 40 may be used with the FIG. 1 implement 10, or it may be used with other implements, whether for mining, excavation or other material handling purposes. The scope of this disclosure is not limited to use of the securement system 40 with any particular type of implement.

In the FIG. 2 example, the securement system 40 is used to secure a shroud 28 to the forward edge of the lip 16, without use of any adapter 14. In other examples, the securement system 40 may be used to secure the shroud 28 to an adapter 14 secured to the forward edge of the lip 16, and/or the securement system may be used to secure the adapter to the forward edge of the lip.

As depicted in FIG. 2, the securement system 40 includes a pin 42 received in a housing 44. The pin 42 is in a locked position as shown in FIG. 2. Bearing surfaces 46, 48 formed on the pin are aligned with respective bearing surfaces 50, 52 formed in the shroud 28. Contact between the two sets of bearing surfaces 46, 50 and 48, 52 prevents removal of the shroud 28 from the implement lip 16.

A lock 54 resists rotation of the pin 42 away from the locked position. Thus, when the pin 42 is in the locked position, intentional additional effort in the form of increased torque is required to rotate the pin away from the locked position.

The housing 44 is received in the shroud 28 and in a recess 56 formed in the lip 16. A protrusion 58 is formed on the housing 44 and is received in a recess 60 formed in the shroud 28. In this position, rotation of the housing 44 in the recess 56 relative to the shroud 28 and the lip 16 is prevented, due to the engagement of the protrusion 58 with the recess 60.

To secure the shroud 28 to the lip 16, the housing 44 is installed in the recess 56. The pin 42 is not in the housing 44 at this point. Then, the shroud 28 is positioned on the lip 16, so that the protrusion 58 is received in the recess 60.

The pin 42 is then installed through an opening 62 in the shroud 28. The pin 42 is received in the housing 44 and, in this example, is threaded into the housing. Eventually, the respective bearing surfaces 46, 50 and 48, 52 are laterally aligned and the pin 42 is in the locked position relative to the housing 44. The engagement between the protrusion 58 and the recess 60 prevents rotation of the housing 44 while the pin 42 is threaded into the housing 44.

Figure 4:
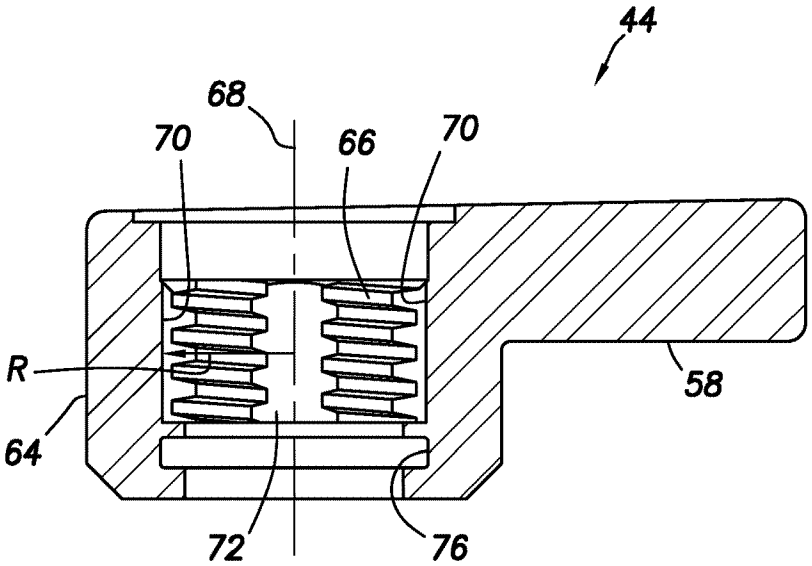
FIG. 4 is a representative cross-sectional view of the housing, taken along line 4-4 of FIG. 3.
Figure 3:
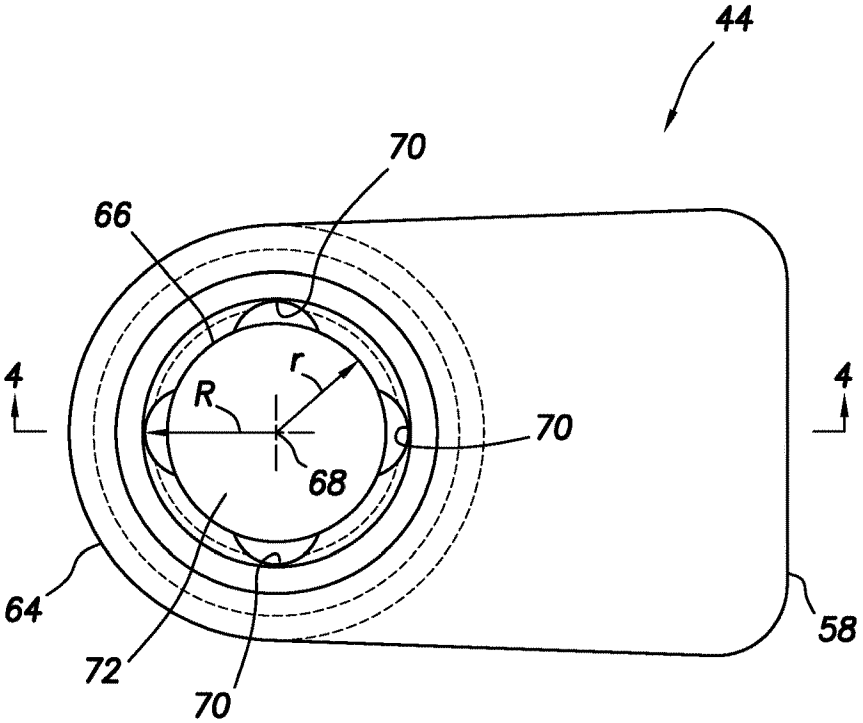
FIG. 3 is a representative top view of an example of a housing of the securement system.

Referring additionally now to FIGS. 3 & 4, more detailed views of an example of the housing 44 are representatively illustrated. In these views, it can be seen that the housing 44 includes a generally cylindrical, internally threaded body 64, with the protrusion 58 extending laterally from one side and one end of the body. In other examples, the protrusion 58 could be separately formed from the body 64 and then the protrusion could be attached to the body by welding, bonding, fastening or other attachment techniques.

Internal threads 66 are formed in the body 64 about a passage 72 extending axially through the body 64. The threads 66 have an inner radius r. The threads 66 have an axis 68, which is also an axis of rotation of the pin 42 (e.g., when the pin is engaged with the threads and is threaded into the housing 44).

Multiple circumferentially spaced apart recesses or detents 70 are formed into the body 64 and threads 66 about the passage 72. At their maximum depth, the detents 70 have a greater radial distance R from the axis 68 than the inner radius r of the threads 66.

In the FIGS. 3 & 4 example, there are four of the detents 70. The detents 70 are equally spaced, so there is a detent every 90 degrees about the axis 68. In other examples, greater or fewer numbers of detents 70 may be provided.

The detents 70 as depicted in FIGS. 3 & 4 are semicircular in shape, and the radial distance R is greater than a maximum radius of the threads 66. However, in other examples the detents 70 could be otherwise shaped, dimensioned or configured. Thus, it should be clearly understood that the scope of this disclosure is not limited to any particular shapes, relative dimensions or configurations of any of the components of the securement system 40 as described herein or depicted in the drawings.

An annular recess 76 is formed in the body 64. The recess 76 is to receive an annular seal 78 (see FIG. 9) which seals between the body 64 and the pin 42, and thereby excludes dirt, debris and contaminants from the threads 66 and the lock 54.

Figure 7:
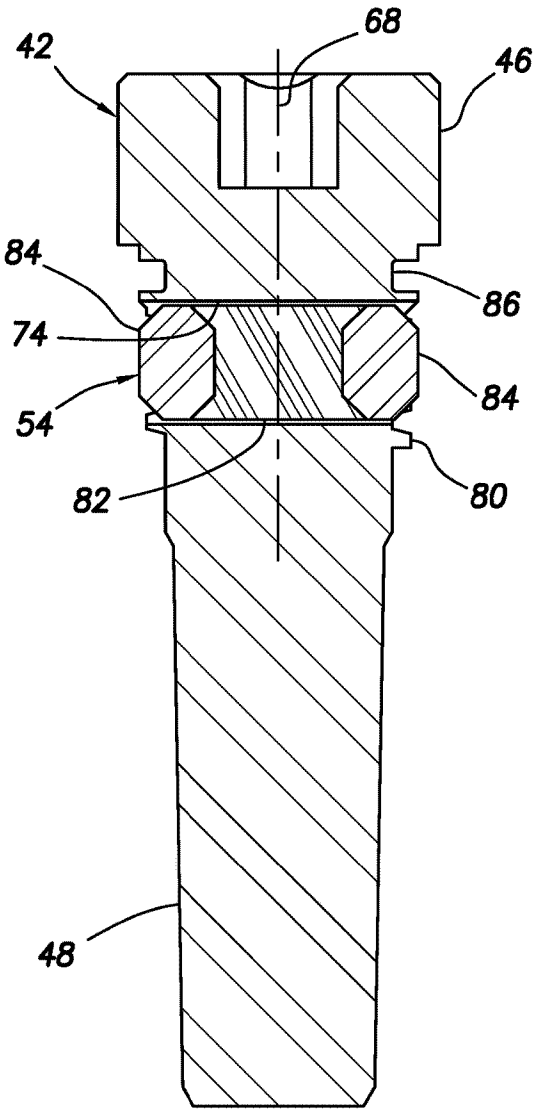
FIG. 7 is a representative cross-sectional view of the pin and the lock components, taken along line 7-7 of FIG. 5.
Figure 6:
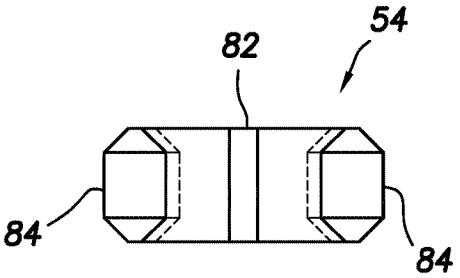
FIG. 6 is a representative side view of an example of components of a lock of the securement system.
Figure 5:
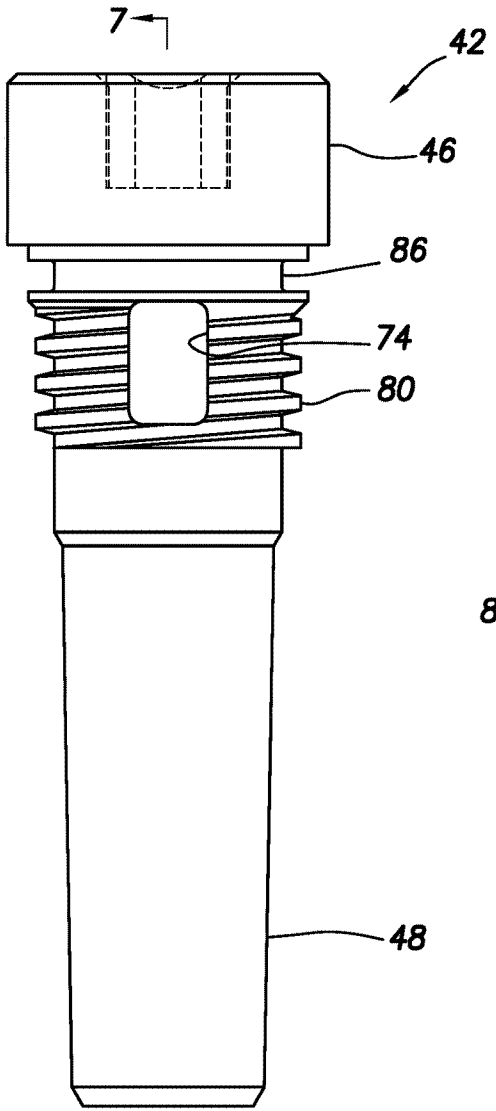
FIG. 5 is a representative side view of an example of a pin of the securement system.

Referring additionally now to FIGS. 5-7, more detailed views of examples of the pin 42 and the lock 54 are representatively illustrated. In this example, components of the lock 54 are received in an opening 74 formed laterally through the pin 42. In other examples, components of the lock 54 may not be received in the pin 42. For example, the detents 70 could instead be formed externally on the pin 42 and the other components of the lock 54 could be received in the housing 44. Thus, the scope of this disclosure is not limited to any particular relative arrangement between the components of the securement system 40.

In the FIGS. 5-7 example, the opening 74 extends laterally through the pin 42. The opening 74 extends through external threads 80. In other examples, the opening 74 could be axially separated from the threads 80.

The lock 54 components received in the opening 74 are depicted in FIG. 6. In this example, the lock 54 components include at least one resilient member 82 positioned between engagement members 84.

The resilient member 82 in this example comprises an elastomer configured to be positioned and compressed between the engagement members 84. Opposite lateral ends of the resilient member 82 are shaped to complementarily engage the engagement members 84.

In other examples, the resilient member 82 could be another type of resilient member, such as, a spring, a compressed gas, etc. Any structure that exerts a biasing force in response to deformation of the structure may be used for the resilient member 82. The scope of this disclosure is not limited to use of any particular type of resilient member.

When the resilient member 82 and the engagement members 84 are installed in the opening 74, as depicted in FIG. 7, the engagement members extend radially outward somewhat past the threads 80. In other examples, the engagement members 84 may not extend outward past the threads 80. When the pin 42 is threaded into the housing 44, the threads 66, 80 engage, and the engagement members 84 can be received in the detents 70 (if the pin 42 is appropriately aligned rotationally relative to the housing).

If the pin 42 is installed in the housing 44, so that the engagement members 84 are engaged with respective ones of the detents 70, then in order for the pin 42 to be rotated away from this position, the engagement members 84 must be displaced radially inward as they engage the minimum radius r of the threads 66. This radially inward displacement of the engagement members 84 compresses the resilient member 82 laterally between the engagement members. As the compression of the resilient member 82 increases, a radially outwardly directed basing force exerted by the resilient member against the engagement members 84 increases.

An annular recess 86 is formed on the pin 42 between the bearing surface 46 and the threads 80. The recess 86 is configured to receive an annular seal 88 (see FIG. 9) to exclude dirt, debris and other contaminants from the threads 66, 80 and the lock 54.

Referring additionally now to FIGS. 8-11, a fully assembled example of the securement system 40 is representatively illustrated. In these views, the manner in which the lock 54 influences rotation of the pin 42 relative to the housing 44 can be more easily seen.

Figure 9:
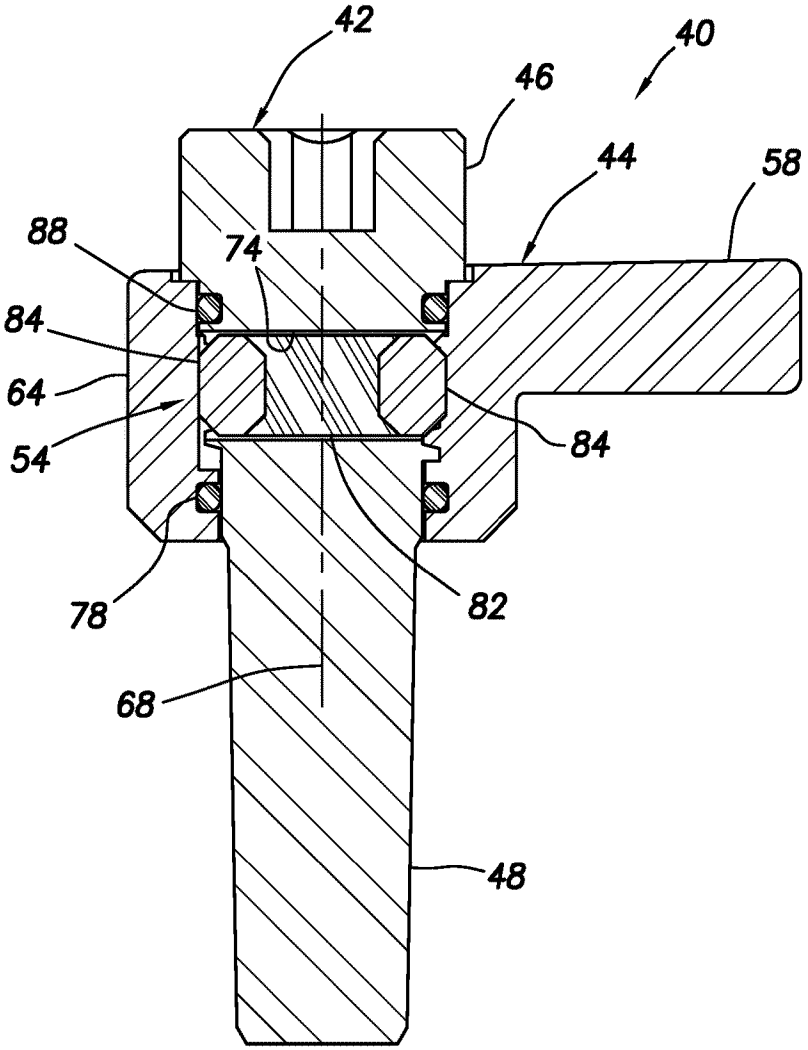
FIG. 9 is a representative cross-sectional view of the securement system, taken along line 9-9 of FIG. 10.
Figure 8:
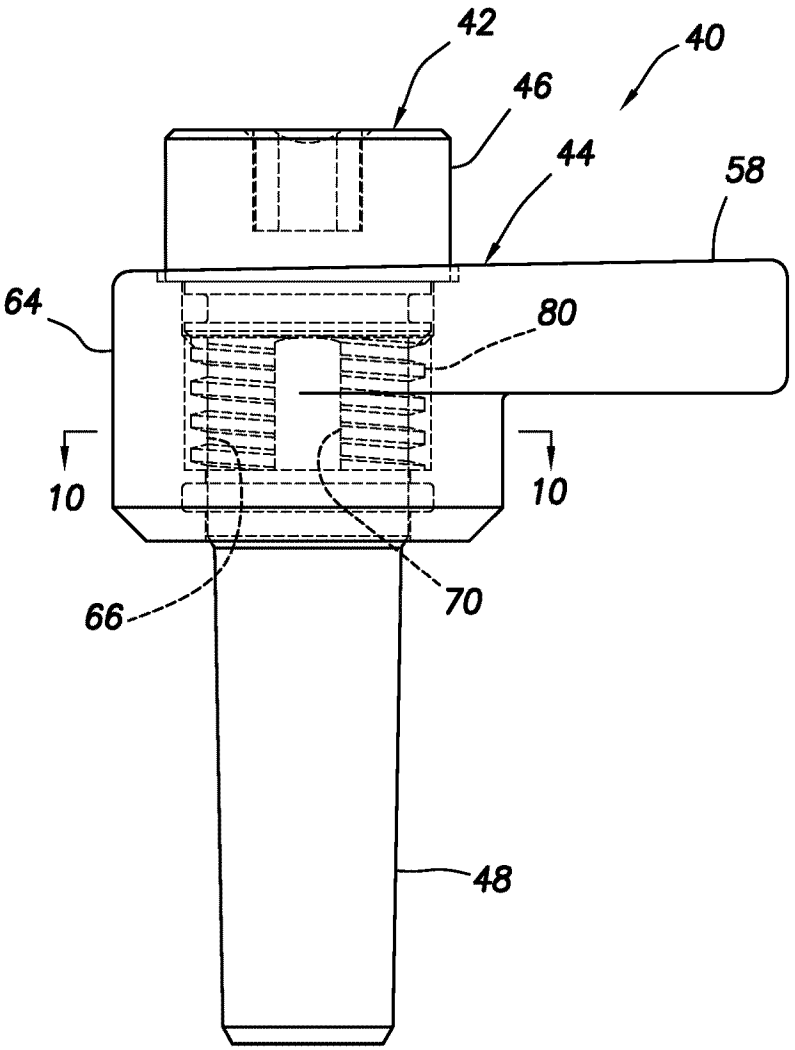
FIG. 8 is a representative side view of the securement system.
Figure 10:
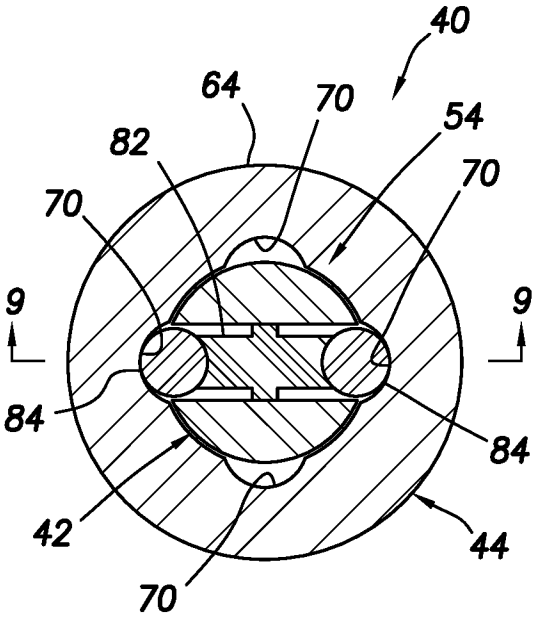
FIG. 10 is a representative cross-sectional view of the securement system, taken along line 10-10 of FIG. 8, with the pin in a locked position.

In FIGS. 8-10, the engagement members 84 are outwardly biased by the resilient member 82 into engagement with a respective pair of the detents 70. The engagement of the members 84 with the detents 70 corresponds to the locked position of the pin 42 relative to the housing 44. The engagement members 84, being biased into the detents 70 by the resilient member 82, thereby resist rotation of the pin 42 away from the locked position.

Figure 11:
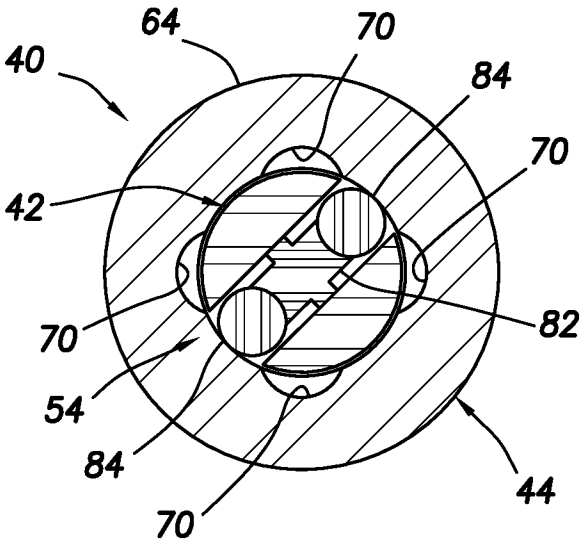
FIG. 11 is a representative cross-sectional view of the securement system, with the pin rotated away from the locked position.

In FIG. 11, the pin 42 has been rotated away from the locked position. Note that the engagement members 84 are no longer engaged with any of the detents 70. The resilient member 82 is laterally compressed between the engagement members 84 (or further compressed, as compared to the FIG. 10 locked position of the pin 42). Thus, a biasing force exerted by the resilient member 82 in the FIG. 11 position is greater than in the FIG. 10 locked position. As a result, increased torque must be applied to the pin 42 in order to rotate it away from the locked position.

Referring additionally now to FIGS. 12-20, another example of the securement system 40 is representatively illustrated. The same reference numerals are used in FIGS. 12-20 to indicate structures similar to those of the FIGS. 2-11 example.

In FIGS. 12-15, views of the housing 44 are representatively illustrated. In these views, it can be seen that the detents 70 are not formed into the threads 66 as in the FIGS. 2-11 example. Instead, the detents 70 are separated from the threads 66 in the FIGS. 12-15 example.

Figure 14:
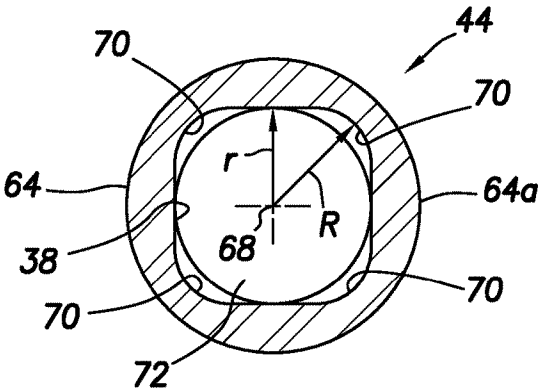
FIG. 14 is a representative cross-sectional view of the FIG. 12 housing, taken along line 14-14 of FIG. 13.
Figure 15:
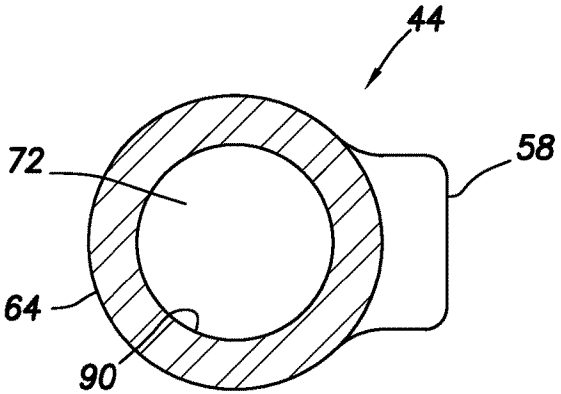
FIG. 15 is a representative cross-sectional view of the FIG. 12 housing, taken along line 14-14 of FIG. 13.
Figure 12:
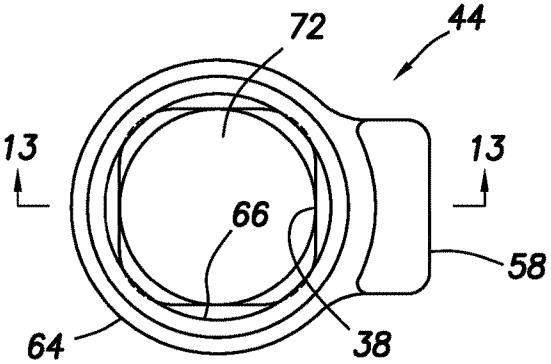
FIG. 12 is a representative top view of another example of the housing.
Figure 13:
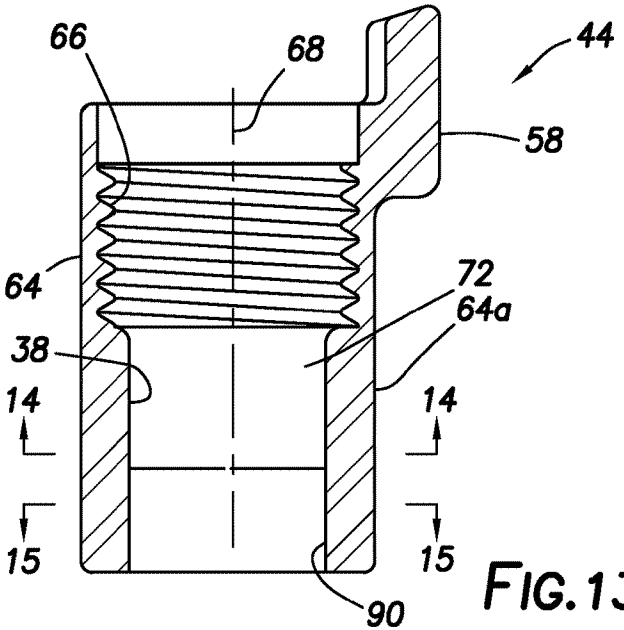
FIG. 13 is a representative cross-sectional view of the FIG. 12 housing, taken along line 13-13 of FIG. 12.

In FIG. 14 it can be seen that the detents 70 comprise rounded internal corners formed in an inner surface 38 in an axial section 64*a* of the body 64. The axial section 64*a* is positioned axially between the threads 66 and a bore 90 configured to receive the pin 42 therein. A radius r, R of the inner surface 38 varies in a circumferential direction, due to the detents 70.

Figure 18:
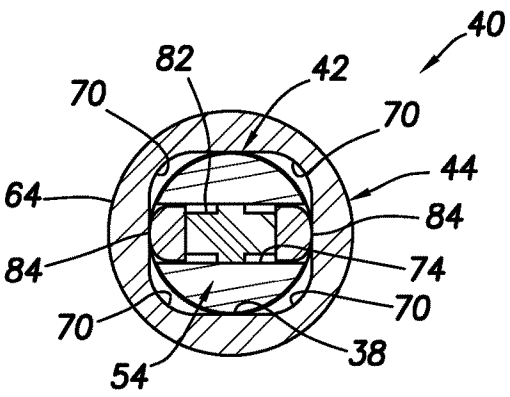
FIG. 18 is a representative cross-sectional view of the securement system, taken along line 18-18 of FIG. 17, with the pin rotated away from the locked position.
Figure 19:
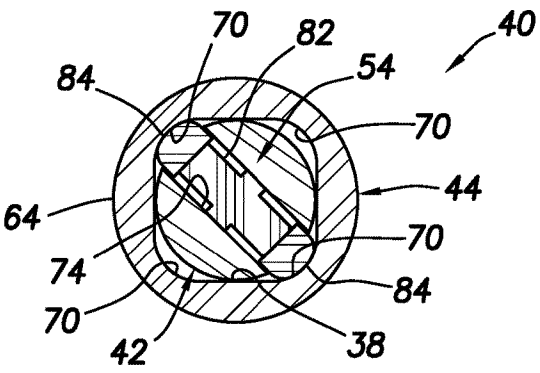
FIG. 19 is a representative cross-sectional view of the securement system, with the pin in the locked position.
Figure 16:
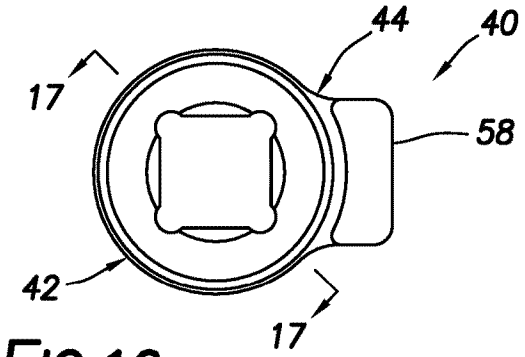
FIG. 16 is a representative top view of another example of the securement system.
Figure 17:
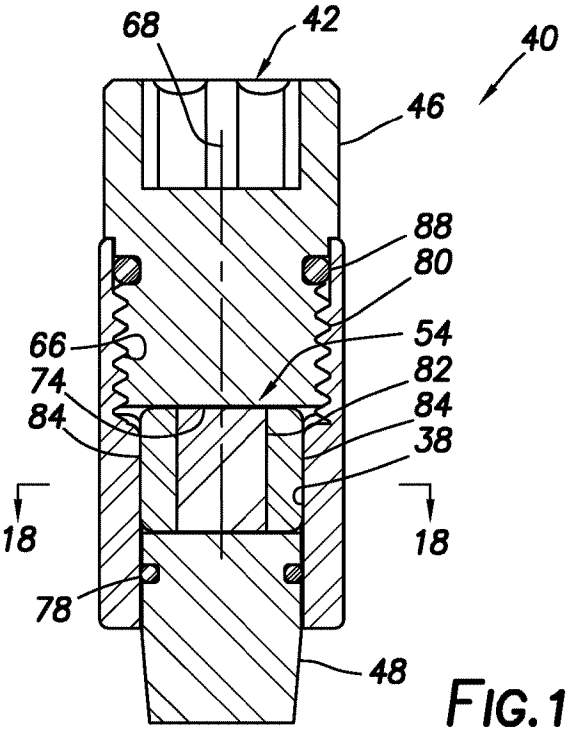
FIG. 17 is a representative cross-sectional view of the FIG. 16 securement system, taken along line 17-17 of FIG. 16.

Referring additionally now to FIGS. 17-19, views of this example of the assembled securement system 40 are representatively illustrated. In FIGS. 16-18, the pin 42 is rotated away from the locked position relative to the housing 44. Note that the resilient member 82 is compressed between the engagement members 84.

In FIG. 17 it can be seen that the opening 74 in this example does not extend through the threads 80. Instead, the opening 74 is axially separated from the threads 80.

In FIG. 19, the pin 42 has been rotated relative to the housing 44, so that the engagement members 84 now engage the respective detents 70. The engagement members 84 displace radially outward from the FIG. 18 position to the FIG. 19 position of the pin 42, so the compression of the resilient member 82 between the engagement members 84 is reduced. As a result, the biasing force exerted by the resilient member 82 is at a minimum when the engagement members 84 are fully engaged in the detents 70, and the biasing force will increase (and thereby increasingly resist rotation) if the pin 42 is rotated away from this position.

Figure 20:
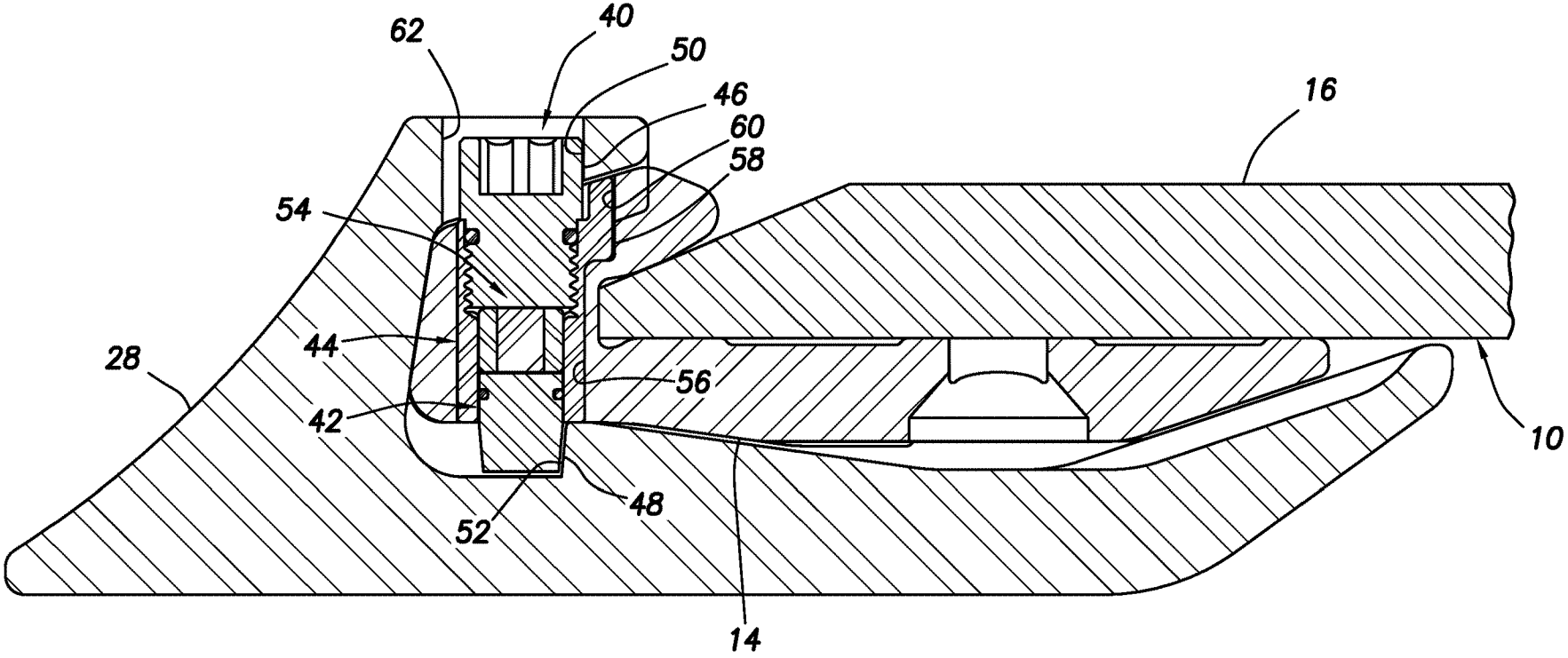
FIG. 20 is a representative cross-sectional view of the FIG. 16 securement system used to secure a wear component to an adapter on the implement.

Referring additionally now to FIG. 20, a cross-sectional view of the FIGS. 12-19 securement system 40 example in use is representatively illustrated. As depicted in FIG. 20, the securement system 40 is being used to secure a shroud 28 to an adapter 14. In other examples, the securement system 40 could be used to secure the adapter 14 to the lip 16, or to secure the shroud 28 (or another type of wear component) directly to the lip without use of the adapter.

To secure the shroud 28 to the adapter 14, the housing 44 is installed in the recess 56 (which is formed in the adapter 14 in this example). The protrusion 58 engages the recess 60 (which is also formed in the adapter 14 in this example). This engagement prevents rotation of the housing 44 relative to the adapter 14.

The shroud 28 is positioned on the adapter 14 as depicted in FIG. 20. The pin 42 (with the resilient member 82 and the engagement members 84 received in the opening 74) is installed through the opening 62 in the shroud 28, and the pin is then threaded into the housing 44.

Eventually, the respective bearing surfaces 46, 50 and 48, 52 are laterally aligned and the engagement members 84 are fully engaged with the respective detents 70 (see FIG. 19), so that the pin 42 is in the locked position. Rotation of the pin 42 away from the locked position will be resisted as described above.

Referring additionally now to FIGS. 21-27, views of another example of the securement system 40 are representatively illustrated. In this example, the resilient member 82 is not received in an opening 74 in the pin 42, so that the resilient member 82 does not rotate with the pin, but instead the pin rotates relative to the resilient member.

Figure 21:
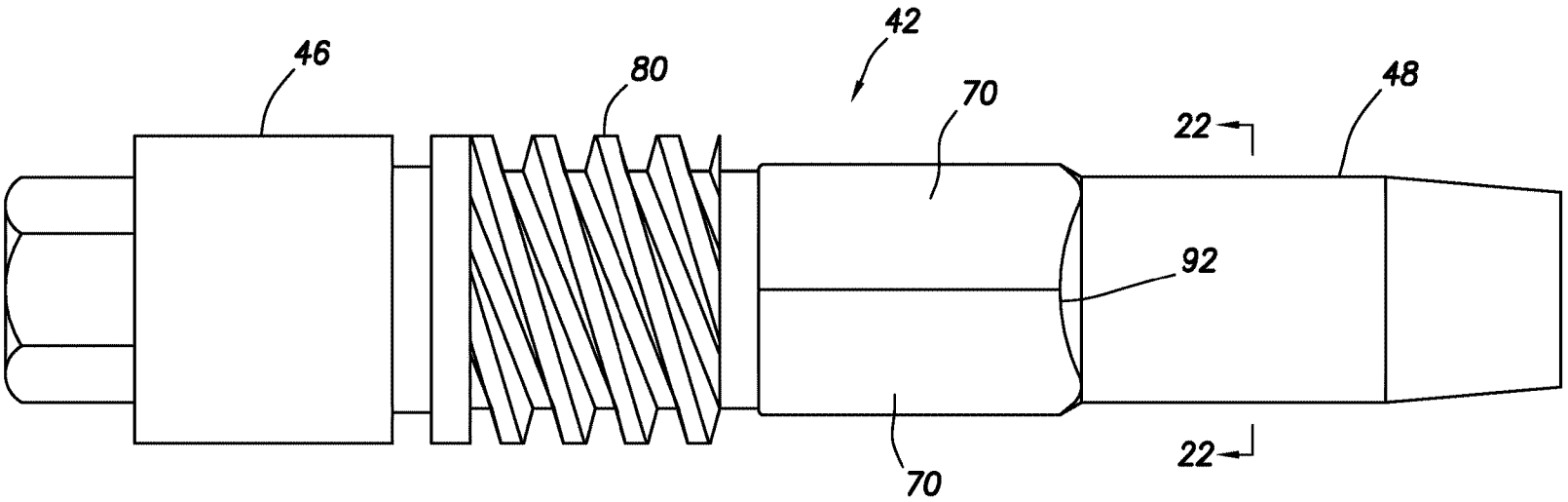
FIG. 21 is a representative side view of another example of the pin.
Figure 22:
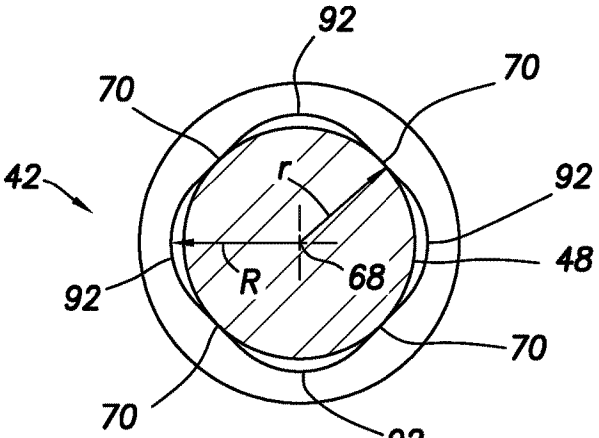
FIG. 22 is a representative cross-sectional view of the pin, taken along line 22-22 of FIG. 21.

In FIGS. 21 & 22, views of one example of the pin 42 are representatively illustrated. In this example, the detents 70 are formed on the pin 42, axially separated from the threads 80. The detents 70 are positioned axially between the threads 80 and the bearing surface 48.

Figure 23:
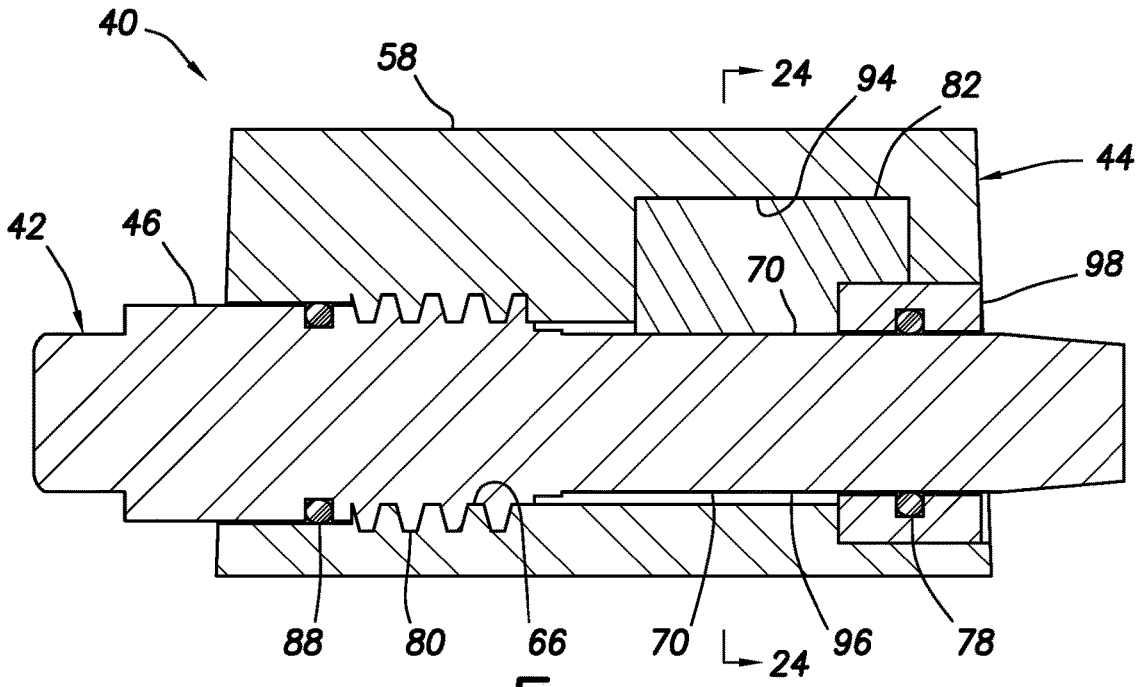
FIG. 23 is a representative cross-sectional view of another example of the securement system.
Figure 24:
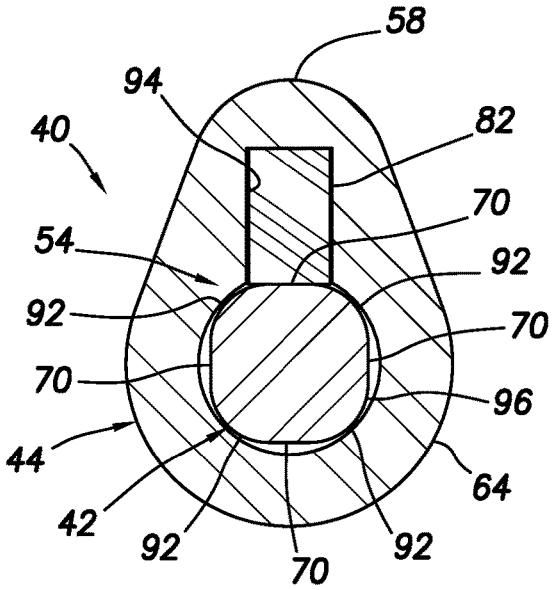
FIG. 24 is a representative cross-sectional view of the securement system, taken along line 24-24 of FIG. 23, with the pin in the locked position.
Figure 25:
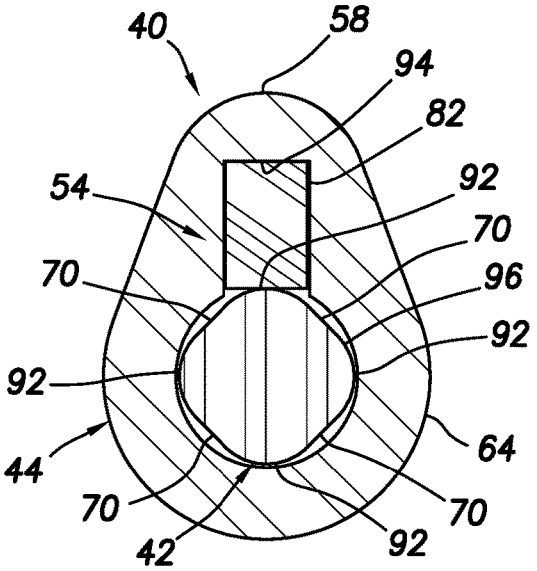
FIG. 25 is a representative cross-sectional view of the securement system, with the pin rotated away from the locked position.

As best viewed in FIG. 22, the detents 70 in this example are radially reduced relative to circumferentially spaced apart radially enlarged lobes 92 formed on a circumferentially extending external surface 96 on the pin 42, so that a radius r, R of the surface 96 varies. Referring additionally now to FIGS. 23-25, it can be seen that the resilient member 82 is received in a recess 94 formed in the housing 44.

The resilient member 82 is arranged in the housing 44 so that the resilient member contacts the external surface 96 of the pin 42 on which the detents 70 and lobes 92 are formed. A bushing 98 is press-fit into the housing 44 to retain the resilient member 82 therein.

In this example, the resilient member 82 directly contacts and applies a biasing force against the external surface 96.

In other examples an engagement member (such as the engagement members 84 described above) could be positioned between the resilient member 82 and the surface 96, so that the engagement member would contact the surface, and the biasing force would be transmitted to the surface via the engagement member.

In FIG. 24, the pin 42 is in the locked position relative to the housing 44. The resilient member 82 is fully engaged with one of the detents 70 on the pin 42. This engagement tends to resist rotation of the pin 42 away from the FIG. 24 locked position.

In FIG. 25, the pin 42 has been rotated away from the locked position. Note that the resilient member 82 is laterally compressed greater in the FIG. 25 position than in the FIG. 24 locked position, so that the biasing force exerted by the resilient member 82 is increased. The biasing force exerted by the resilient member 82 is at a minimum when the resilient member 82 is fully engaged with one of the detents 70, and the biasing force will increase (and thereby increasingly resist rotation) if the pin 42 is rotated away from this position.

Figure 26:
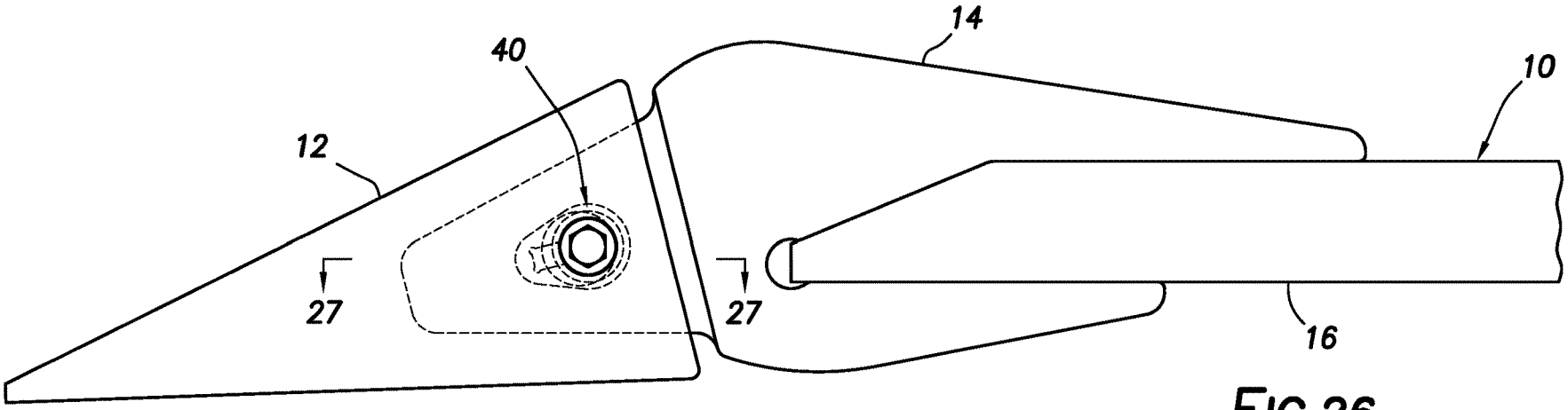
FIG. 26 is a representative side view of the FIG. 23 securement system used to secure a wear component to an adapter on the implement.
Figure 27:
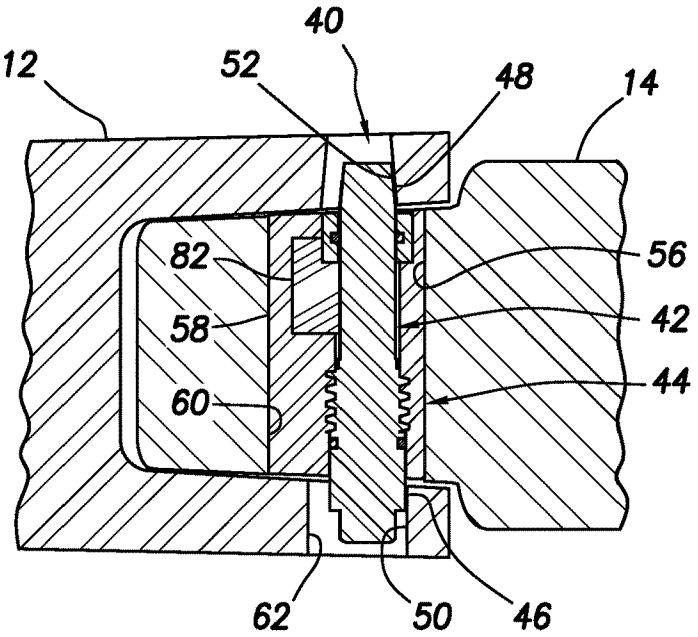
FIG. 27 is a representative cross-sectional view of the securement system, taken along line 27-27 of FIG. 26.
Figure 28:
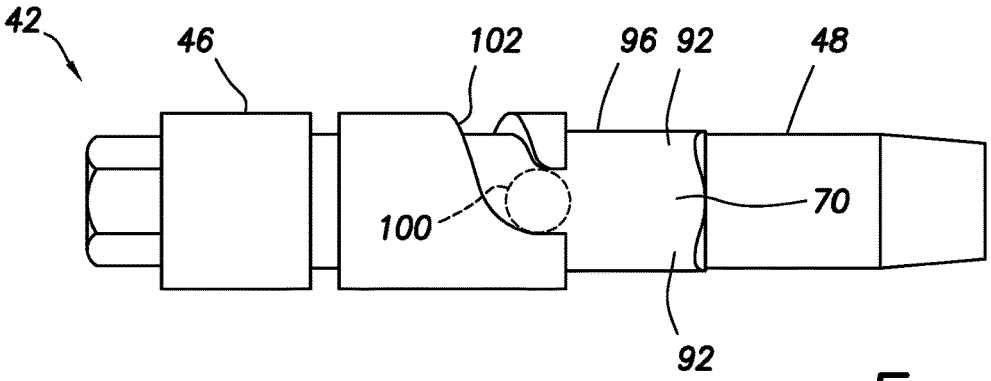
FIGS. 28-31 are representative successive side views of another example of the pin, rotated in ninety degree increments.
Figure 29:
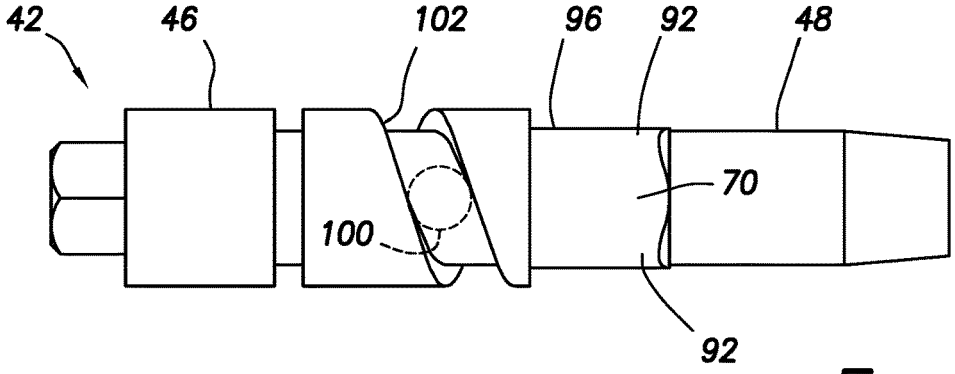
Figure 30:
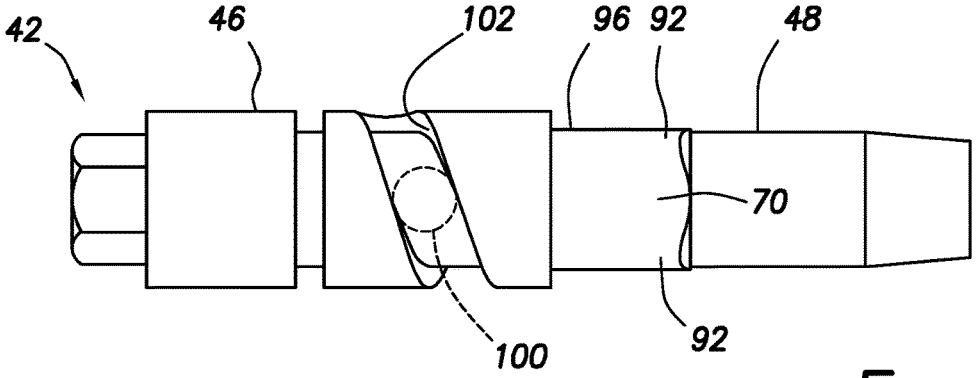
Figure 31:
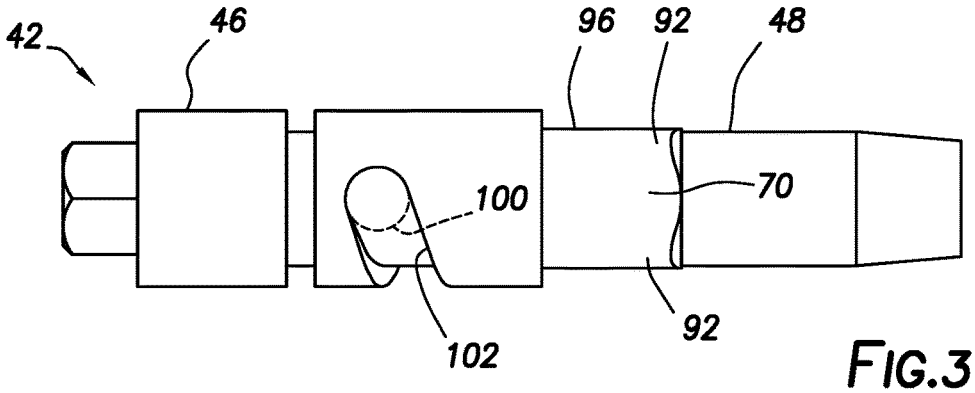

Referring additionally now to FIGS. 26 & 27, views of the FIGS. 21-25 securement system 40 example in use are representatively illustrated. As depicted in FIGS. 26 & 27, the securement system 40 is being used to secure a tooth 12 to an adapter 14. In other examples, the securement system 40 could be used to secure the adapter 14 to the lip 16, or to secure the tooth 12 (or another type of wear component) directly to the lip without use of the adapter.

To secure the tooth 12 to the adapter 14, the housing 44 is installed in the recess 56 (which is formed in the adapter 14 in this example). The protrusion 58 engages the recess 60 (which is also formed in the adapter 14 in this example). This engagement prevents rotation of the housing 44 relative to the adapter 14.

The tooth 12 is positioned on the adapter 14 as depicted in FIG. 27. The pin 42 is installed through the opening 62 in the tooth 12, and the pin is then threaded into the housing 44.

Eventually, the respective bearing surfaces 46, 50 and 48, 52 are laterally aligned and the resilient member 82 is fully engaged with one of the detents 70 (see FIG. 24), so that the pin 42 is in the locked position. Rotation of the pin 42 away from the locked position will be resisted as described above.

Referring additionally now to FIGS. 28-34, views of another example of the securement system 40 are representatively illustrated. The same reference numerals are used to indicate components of the FIGS. 28-34 securement system 40 which are similar to components of the other securement system examples described above. The FIGS. 28-34 securement system 40 may be used in place of the FIGS. 21-27 securement system as described above.

In FIGS. 28-31, the pin 42 is representatively illustrated in a series of rotational positions relative to a cam follower 100. The cam follower 100 engages and slides along a mostly helical groove or cam 102 formed on the pin 42.

The pin 42 is rotated 90 degrees between the FIGS. 28-31 in succession, but the cam follower 100 does not rotate with the pin. As a result, the cam follower 100 displaces axially relative to the pin 42 (or the pin displaces axially relative to the cam follower) from FIG. 28 to FIG. 31.

Figure 32:
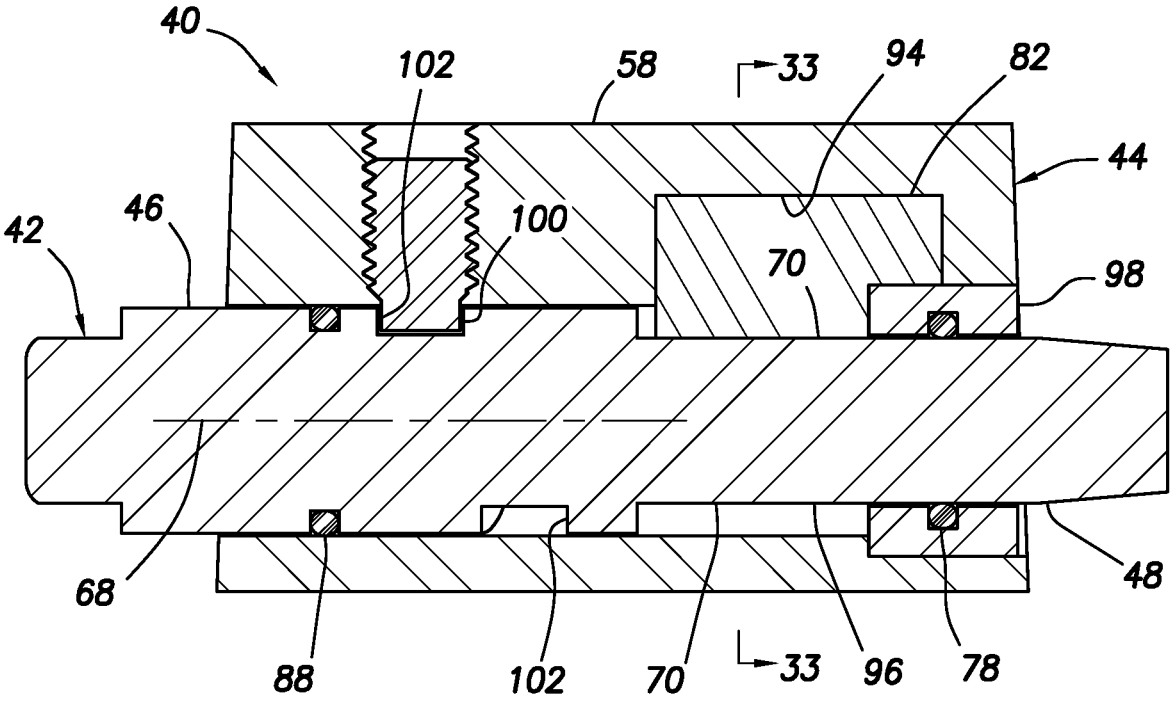
FIG. 32 is a representative cross-sectional view of another example of the securement system.
Figure 33:
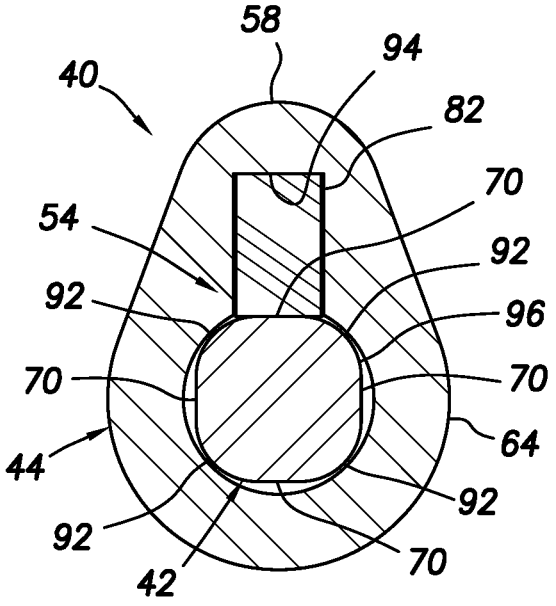
FIG. 33 is a representative cross-sectional view of the securement system, taken along line 33-33 of FIG. 32, with the pin in the locked position.
Figure 34:
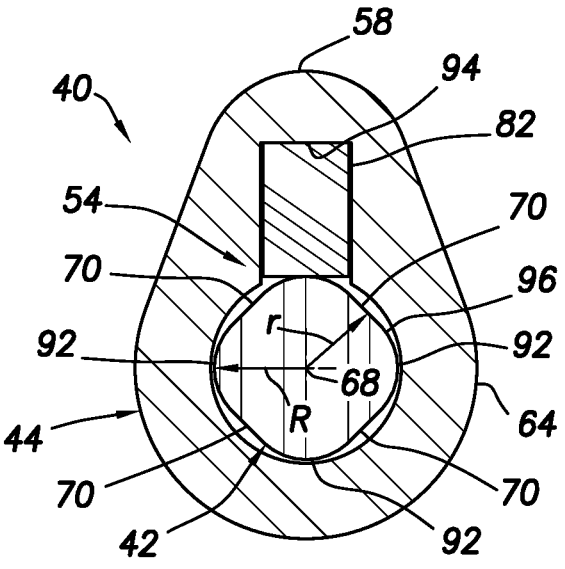
FIG. 34 is a representative cross-sectional view of the securement system, with the pin rotated away from the locked position.
Figure 35:
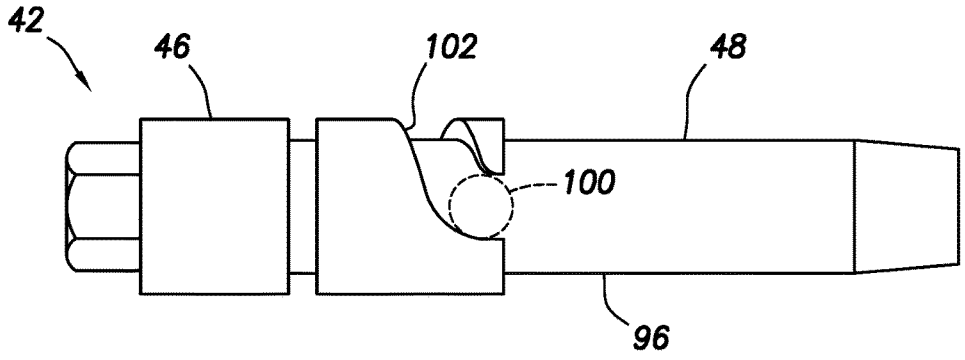
FIGS. 35-38 are representative successive side views of another example of the pin, rotated in ninety degree increments.
Figure 36:
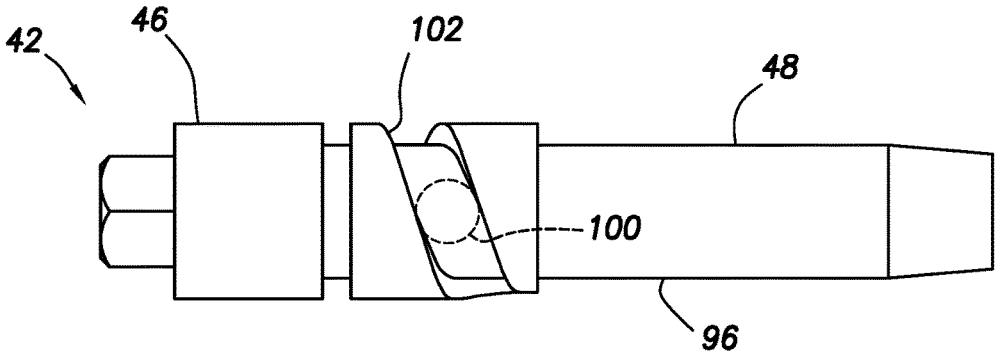
Figure 37:
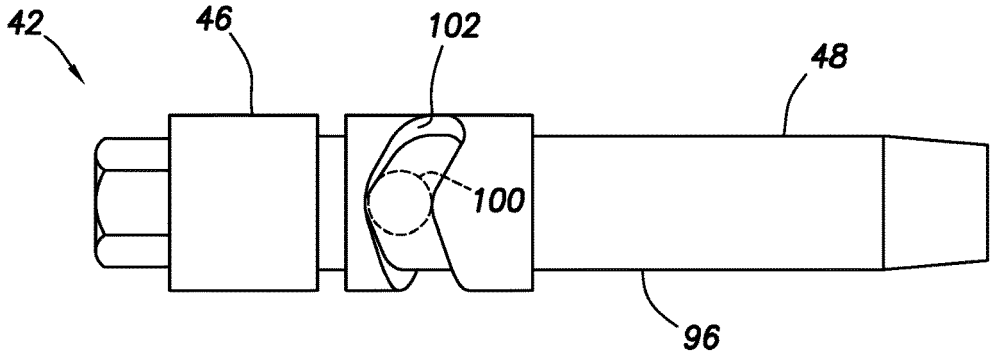
Figure 38:
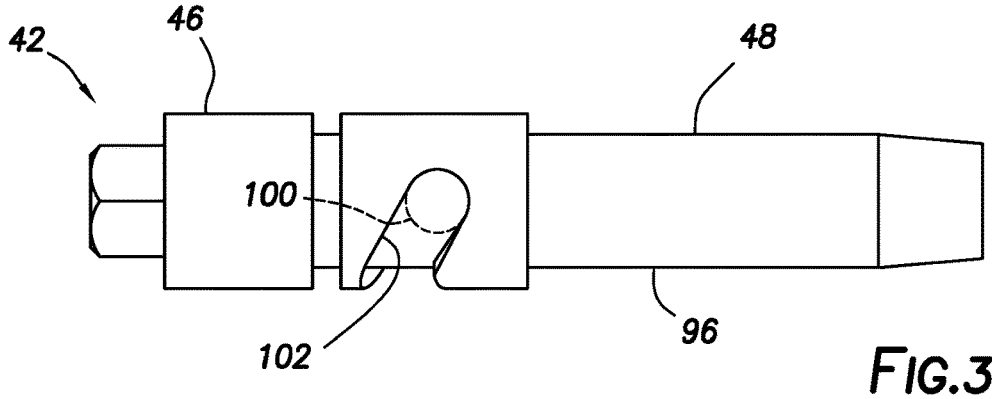

In FIGS. 32-34, the securement system 40 is fully assembled. The cam follower 100 in this example is in the form of a threaded pin installed into the housing 44. In other examples, a different type of cam follower may be used, and the positions of the cam and cam follower could be reversed (with the cam 102 formed in the housing 44 and the cam follower 100 formed on the pin 42).

In FIG. 33, the pin 42 is in the locked position relative to the housing 44. The resilient member 82 is fully engaged with one of the detents 70 on the pin 42. This engagement tends to resist rotation of the pin 42 away from the FIG. 33 locked position.

In FIG. 34, the pin 42 has been rotated away from the locked position. Note that the resilient member 82 is laterally compressed greater in the FIG. 34 position than in the FIG. 33 locked position, so that the biasing force exerted by the resilient member 82 is increased. The biasing force exerted by the resilient member 82 is at a minimum when the resilient member 82 is fully engaged with one of the detents 70, and the biasing force will increase (and thereby increasingly resist rotation) if the pin 42 is rotated away from this position.

Referring additionally now to FIGS. 35-41, views of another example of the securement system 40 are representatively illustrated. The same reference numerals are used to indicate components of the FIGS. 35-41 securement system 40 which are similar to components of the other securement system examples described above. The FIGS. 35-41 securement system 40 may be used in place of the FIGS. 21-27 securement system as described above.

In FIGS. 35-38, the pin 42 is representatively illustrated in a series of rotational positions relative to the cam follower 100. The cam follower 100 engages and slides along the helical groove or cam 102 formed on the pin 42.

The pin 42 is rotated 90 degrees between the FIGS. 35-38 positions in succession, but the cam follower 100 does not rotate with the pin. As a result, the cam follower 100 displaces axially relative to the pin 42 (or the pin displaces axially relative to the cam follower) from FIG. 35 to FIG. 38.

The FIGS. 35-38 pin 42 differs in some respects from the FIGS. 28-34 pin in that the FIGS. 35-38 pin does not have the detents 70 or lobes 92 formed on the external surface 96, and a profile of the cam 102 is different. Note that, as the pin 42 is rotated from the FIG. 35 position to the FIG. 36 position, and then from the FIG. 36 position to the FIG. 37 position, the pin is displaced axially to the right relative to the cam follower 100. However, if the pin 42 is further rotated from the FIG. 37 position to the FIG. 38 locked position, the pin is displaced axially to the left relative to the cam follower 100.

Figure 39:
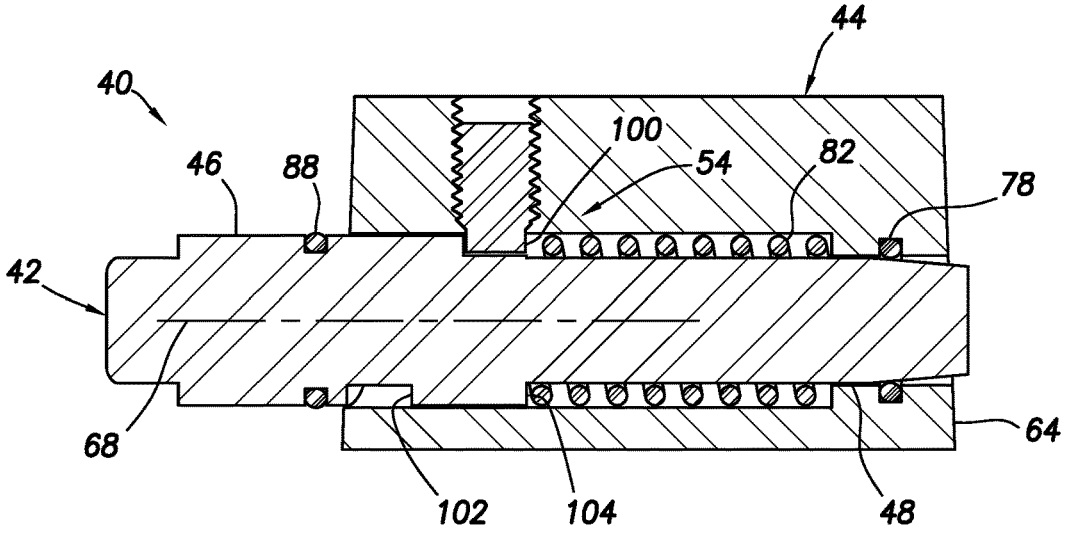
FIGS. 39-41 are representative successive cross-sectional views of another example of the securement system in operation, the pin installed in the housing in FIG. 39, the pin rotated away from the locked position in FIG. 40, and the pin in the locked position in FIG. 41.
Figure 40:
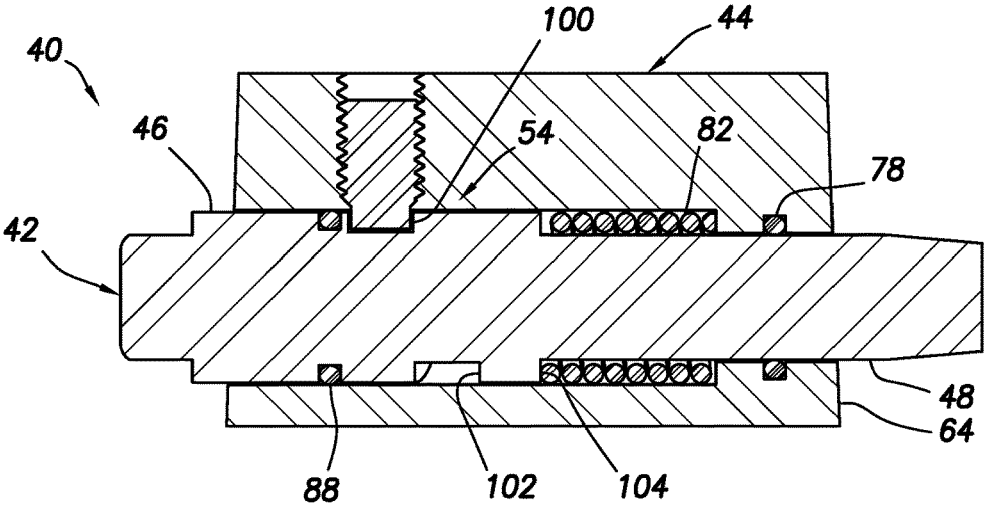
Figure 41:
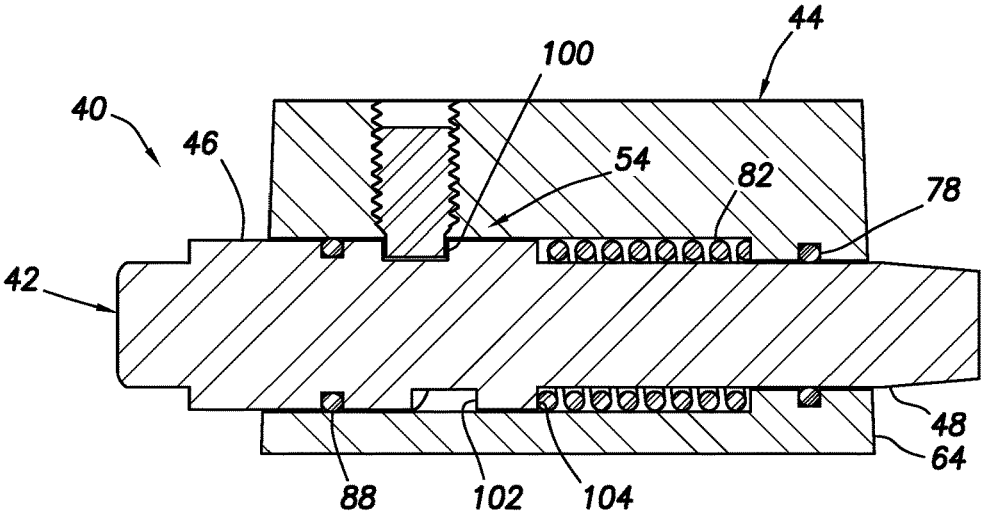

In FIGS. 39-41, the securement system 40 is fully assembled and depicted in a series of configurations of operation. The FIG. 39 configuration corresponds to the relative positions of the pin 42 and the cam follower 100 (which is secured to the housing 44) depicted in FIG. 35, the FIG. 40 configuration corresponds to the relative positions of the pin and the cam follower depicted in FIG. 37, and the FIG. 41 configuration corresponds to the relative positions of the pin and the cam follower depicted in FIG. 38.

Note that the resilient member 82 in this example is in the form of a compression spring positioned in the housing 44. The resilient member 82 applies an axially directed biasing force against an annular shoulder 104 formed on the pin 42.

In FIG. 39, the pin 42 is installed in the housing 44, so that the cam follower 100 initially engages the cam 102. At this point, the resilient member 82 may apply the axially directed biasing force to the shoulder 104, or the biasing force may arise as the pin 42 is rotated from the FIG. 39 position to the FIG. 40 position.

Since the pin 42 displaces to the right relative to the cam follower 100 when the pin is rotated from the FIG. 39 position to the FIG. 40 position, the resilient member 82 is axially compressed more and the biasing force exerted by the resilient member is greater, in the FIG. 40 position as compared to the FIG. 39 position.

In FIG. 41, the pin 42 has been rotated further relative to the housing 44. In this position of the pin 42, the pin is displaced axially to the left somewhat as compared to its FIG. 40 position. Therefore, the resilient member 82 is axially compressed less and the biasing force exerted by the resilient member is reduced, in the FIG. 41 locked position as compared to the FIG. 40 position. In the FIG. 41 locked position, the respective bearing surfaces 46, 50 and 48, 52 are laterally aligned (see FIG. 27).

Note that the resilient member 82 must be increasingly compressed and the biasing force exerted by the resilient member will increase if the pin 42 is rotated from the FIG. 41 locked position to the FIG. 40 position. Thus, the biasing force acting on the pin 42 and the profile of the cam 102 cooperate to resist rotation of the pin 42 away from the FIG. 41 locked position.

It may now be fully appreciated that the above disclosure provides significant advancements to the art of securing wear components to material handling implements. In examples of the securement system 40 described above, a pin 42 used to secure a wear component (such as, a tooth 12, a shroud 28, 30 or an adapter 14) to a lip 16 of an implement 10 is installed in a housing 44 and is rotated to a locked position. Rotation of the pin 42 away from the locked position is resisted by a lock 54 that includes a resilient member 82.

In some examples, the resilient member 82 rotates with the pin 42, so that the resilient member or one or more engagement members 84 engages a series of circumferentially spaced apart detents 70. In other examples, the resilient member 82 is secured to the housing 44, so that the resilient member or one or more engagement members 84 engages a series of circumferentially spaced apart detents 70 on the pin 42. In at least one example, the resilient member 82 is axially compressed in the housing 44, with the amount of compression being determined by relative positions of a cam 102 and a cam follower 100 on the pin 42 and in the housing.

The present disclosure provides to the art a wear component securement system 40 for securing a wear component (such as, the tooth 12, an adapter 14, shrouds 28, 30, etc.) to a material handling implement 10. In one example, the system 40 includes a housing 44 securable against rotation relative to the wear component; a pin 42 rotatable in a passage 72 of the housing 44 about an axis of rotation 68, the pin 42 being configured to displace along the axis of rotation 68 in response to rotation of the pin 42 in the housing passage 72; and a resilient member 82 that resists rotation of the pin 42 away from a locked position relative to the housing 44.

The pin 42 and the resilient member 82 may be rotatable together relative to the housing 44. The pin 42 may be rotatable relative to the housing 44 and the resilient member 82.

The resilient member 82 may be secured against rotation relative to the housing 44. The resilient member 82 may be secured against rotation relative to the pin 42 (e.g., by being received in the opening 74 in the pin).

Complementary threads 80, 66 may be formed on the pin 42 and in the housing 44.

A cam 102 may be positioned on one of the pin 42 and the housing 44. A cam follower 100 may be positioned on the other of the pin 42 and the housing 44.

The resilient member 82 may comprise an elastomer or a spring, or another type of biasing device. The resilient member 82 may exert a biasing force against a circumferentially extending outer surface 96 of the pin 42.

A radius R, r of the outer surface 96 may vary in a circumferential direction.

The resilient member 82 may be configured to compress in response to an increase in the biasing force.

The housing 44 may comprise a protrusion 58 configured to engage a recess 60 formed in the wear component. Engagement between the protrusion 58 and the recess 60 can prevent rotation of the housing 44 relative to the wear component.

The resilient member 82 may exert a biasing force against a circumferentially extending inner surface 38 in the housing 44. A radius r, R of the inner surface 38 may vary in a circumferential direction.

The resilient member 82 may be received in an opening 74 formed through the pin 42. The opening 74 may extend through threads 80 formed on the pin 42. The opening 74 may be axially separated from threads formed on the pin.

The resilient member 82 may exert an axially directed biasing force against the pin 42.

A method of securing a wear component (such as, a tooth 12, and adapter 14 or shrouds 28, 30) to a material handling implement 10 is also provided to the art by the present disclosure. In one example, the method can include: installing a housing 44 of a wear component securement system 40, the securement system 40 comprising a pin 42 rotatably received in the housing 44, and a resilient member 82 that resists rotation of the pin 42 relative to the housing 44, the installing step comprising preventing rotation of the housing 44 relative to the wear component, and rotating the pin 42 to a locked position relative to the housing 44, thereby aligning at least one bearing surface 46, 48 of the pin 42 with at least one bearing surface 50, 52 of the wear component.

The rotating step my include reducing a biasing force exerted by the resilient member 82 while the pin 42 is being rotated toward the locked position.

The pin 42 may displace along an axis of rotation 68 in response to the rotating of the pin 42. The rotating step may include the pin 42 and the resilient member 82 rotating together relative to the housing 44. The rotating step may include the pin 42 rotating relative to the housing 44 and the resilient member 82.

The resilient member 82 may be secured against rotation relative to the housing 44. The resilient member 82 may be secured against rotation relative to the pin 42.

Complementary threads 80, 66 may be formed on the pin 42 and in the housing 44.

A cam 102 may be positioned on one of the pin 42 and the housing 44, a cam follower 100 may be positioned on the other of the pin 42 and the housing 44. The rotating step may include producing relative rotation between the cam 102 and the cam follower 100.

The resilient member 82 may comprise an elastomer or a spring. The rotating step may include the resilient member 82 exerting a biasing force against a circumferentially extending outer surface 96 of the pin 42. A radius r, R of the outer surface 96 may vary in a circumferential direction.

The resilient member 82 may be configured to compress in response to an increase in the biasing force.

The housing 44 may comprise a protrusion 58 configured to engage a recess 60 formed in the wear component. The installing step may include engagement between the protrusion 58 and the recess 60 preventing rotation of the housing 44 relative to the wear component.

The resilient member 82 may exert a biasing force against a circumferentially extending inner surface 38 in the housing 44. A radius r, R of the inner surface 38 may vary in a circumferential direction.

The resilient member 82 may be received in an opening 74 formed through the pin 42. The opening 74 may extend through threads 80 formed on the pin 42.

The resilient member 82 may be received in an opening 74 formed through the pin 42, the opening 74 being axially separated from threads 80 formed on the pin 42.

The resilient member 82 may exert an axially directed biasing force against the pin 42.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A wear component securement system for securing a wear component to a material handling implement, the system comprising:

a housing securable against rotation relative to the wear component, in which the housing includes an axial passage, and in which the housing passage includes at least two longitudinal recesses elongated in a direction parallel to the axial passage;

a pin rotatable in the housing passage about an axis of rotation, in which the pin is configured to displace along the axis of rotation in response to rotation of the pin in the housing passage; and a resilient member received in an opening formed laterally through the pin, in which the resilient member simultaneously exerts first and second biasing forces against an inner surface of the housing passage, and in which rotation of the pin relative to the housing is resisted when the first and second biasing forces are concurrently aligned with the longitudinal recesses.

2. The system of claim 1, in which the pin and the resilient member are rotatable together relative to the housing.

3. The system of claim 1, in which complementary threads are formed on the pin and in the housing.

4. The system of claim 1, in which the resilient member comprises an elastomer.

5. The system of claim 1, in which the resilient member comprises a spring.

6. The system of claim 1, in which the housing comprises a protrusion configured to engage a recess formed in the wear component, whereby engagement between the protrusion and the recess formed in the wear component prevents rotation of the housing relative to the wear component.

7. The system of claim 1, in which the first and second biasing forces are in opposite radial directions.

8. The system of claim 1, in which a radius of the inner surface varies in a circumferential direction.

9. The system of claim 3, in which the opening extends through the threads formed on the pin.

10. The system of claim 3, in which the opening is axially separated from the threads formed on the pin.

11. The system of claim 7, in which the resilient member is configured to compress in response to an increase in the biasing forces.

* * * * *